US005425309A

United States Patent [19]

Saito et al.

[11] Patent Number: 5,425,309

[45] Date of Patent: Jun. 20, 1995

[54] CLEANING APPARATUS FOR PRINTING PRESS

[75] Inventors: Nobuaki Saito; Jun Kamiyama, both of Ibaragi, Japan

[73] Assignee: Komori Corporation, Tokyo, Japan

[21] Appl. No.: 176,856

[22] Filed: Dec. 29, 1993

[30] Foreign Application Priority Data

Jan. 11, 1993 [JP] Japan ..... 5-002793 U

[51] Int. Cl.[6] ..... B41F 35/06

[52] U.S. Cl. ..... 101/423; 101/425

[58] Field of Search ..... 101/423, 424, 425, DIG. 35, 101/DIG. 31; 15/256.51

[56] References Cited

U.S. PATENT DOCUMENTS

| | | | |
|---|---|---|---|
| 2,341,020 | 2/1944 | Willoughby . | |
| 3,562,758 | 3/1968 | Ringrose | 15/256.5 |
| 3,486,448 | 12/1969 | Anderson et al. | 15/256.51 |
| 4,135,448 | 1/1979 | Moestue . | |
| 4,651,644 | 3/1987 | Kaempfe et al. . | |
| 5,105,740 | 4/1992 | Loos et al. | 101/423 |
| 5,168,812 | 12/1992 | Sugiyama | 101/425 |
| 5,176,080 | 1/1993 | Gasparrini et al. | 101/425 |

FOREIGN PATENT DOCUMENTS

| | | | |
|---|---|---|---|
| 0515013 | 11/1992 | European Pat. Off. | B41F 35/04 |
| 0539771 | 5/1993 | European Pat. Off. | B65H 75/24 |
| 0552857 | 7/1993 | European Pat. Off. | B41F 35/00 |
| 0564795 | 10/1993 | European Pat. Off. | B41F 35/00 |
| 0331550 | 9/1958 | France | 15/256.51 |
| 2146817 | 2/1973 | France | B41I 41/00 |
| 2636268 | 3/1990 | France | B41F 35/06 |
| 9108433 | of 0000 | Germany | B41F 35/00 |
| 3529865 | 5/1986 | Germany . | |
| 62-074656 | 6/1987 | Japan | B41B 35/02 |

*Primary Examiner*—Edgr S. Burr
*Assistant Examiner*—Anthony H. Nguyen
*Attorney, Agent, or Firm*—Blakely, Sokoloff, Taylor & Zafman

[57] ABSTRACT

A cleaning apparatus for a printing press includes a cleaning unit, apparatus frames, a locking member, and air cylinders. The cleaning unit has a supply roll on which a web for cleaning a cylinder/roller is wound and a take-up roll for taking up the web drawn from the supply roll, and rotatably supports the supply and take-up rolls. The apparatus frames detachably support the cleaning unit. The locking member fixes and holds the cleaning unit on the apparatus frames. The air cylinders are fixed on the apparatus frames and rotate the take-up roll in a direction to take up the web.

11 Claims, 6 Drawing Sheets

CLEANING APPARATUS FOR PRINTING PRESS

BACKGROUND OF THE INVENTION

The present invention relates to a cleaning apparatus for various types of printing presses, which cleans the printing cylinders, e.g., a blanket cylinder and an impression cylinder, and rollers, e.g., a form roller and a vibrating roller.

Various types of printing presses, e.g., an offset printing press and an intaglio printing press, have printing cylinders, e.g., a plate cylinder, a blanket cylinder, and an impression cylinder, and rollers, e.g., a form roller and a vibrating roller. During printing, foreign matters, e.g., ink dust and paper dust attach to the circumferential surfaces of these printing cylinders and rollers to degrade the quality of printed matter. Hence, the printing press is provided with a cleaning apparatus for removing these foreign matters.

The cleaning apparatus of this type has a supply roll and a take-up roll. The supply and take-up rolls extend in the axial direction of a printing cylinder to be cleaned, e.g., the blanket cylinder, to be close to its circumferential surface. Each roll has two end portions rotatably supported by the bearings of the frame. A belt-like cleaning web (to be merely referred to as a web hereinafter) constituted by an unwoven fabric or the like is wound on the supply roll. The web is drawn from the supply roll by rotating the take-up roll with a drive unit, pressed against the circumferential surface of the blanket cylinder with a guide roller or a pad provided between the supply and take-up rolls, and taken up by the take-up roll.

With this arrangement, when the blanket cylinder is rotated and the take-up roll is intermittently rotated to intermittently drive the web, the foreign matters attaching to the circumferential surface of the blanket cylinder are wiped with the web and transferred to the web. The web after the wiping operation is taken up by the take-up roll with the foreign matters attaching to it.

When the ink roller is to be cleaned, for example, a cleaning apparatus for scraping the foreign matters attaching to the circumferential surface of the ink roller with a doctor is employed. More specifically, in a cleaning state, the doctor is obliquely provided between the supply and take-up rolls with its distal end facing upward. The doctor is separated from the circumferential surface of the ink roller, so that its proximal end portion is brought into contact with the web traveling from the supply roll to the take-up roll and that its distal end opposes to contact the circumferential surface of the ink roller.

With this arrangement, after the distal end of the doctor opposes to contact the circumferential surface of the ink roller, when the ink roller is rotated and the take-up roll is intermittently rotated, the web is intermittently driven. Then, the foreign matters attaching to the circumferential surface of the ink roller are scraped by the distal end of the doctor, moved downward on the flat surface of the doctor, and transferred from the proximal end portion of the doctor to the web. The web passing by the proximal end portion of the doctor is taken up by the take-up roll with the foreign matters attaching to it.

In the cleaning apparatus of this type, if the apparatus is kept mounted on the frame when it is not in use, the operation of the printing press is hindered. Therefore, the entire cleaning apparatus is removed from the printing press and stored. When the web wound on the supply roll runs out, the empty supply roll is removed from the support members of the apparatus frames and exchanged for a new supply roll having a web wound on it. Simultaneously, the take-up roll having the web fully wound on it is exchanged for a new empty take-up roll.

Therefore, conventionally, the cleaning unit is constituted by a supply roll, a take-up roll, and apparatus frames supporting the two rolls and a doctor. The cleaning unit is detachably mounted on the frame of the printing press, thereby allowing storage of the cleaning unit and exchange of the web.

However, in the conventional cleaning apparatus, since all the air cylinders and levers for driving the take-up roll are provided on the cleaning unit side, the entire cleaning unit is considerably heavy. Hence, to clean a roller, this heavy cleaning unit must be mounted on or removed from the frame of the printing press. Regarding exchange of the web, not only this heavy cleaning unit but also the pipes of the air cylinders for driving the take-up roll must be mounted on and removed from the frame of the printing press, requiring a time-consuming heavy labor.

SUMMARY OF THE INVENTION

It is an object of the present invention to provide a cleaning apparatus for a printing press which facilitates mounting and removal of a cleaning unit on and from the frame of the printing press within a short period of time.

In order to achieve the above object, according to the present invention, there is provided a cleaning apparatus for a printing press, comprising a cleaning unit, having a supply roll on which a web for cleaning a cylinder/roller is wound and a take-up roll for taking up the web drawn from the supply roll, for rotatably supporting the supply and take-up rolls, a frame for detachably supporting the cleaning unit, holding means for fixing and holding the cleaning unit on the frame, and driving means, fixed on the frame, for rotating the take-up roll in a direction to take up the web.

DESCRIPTION OF THE PREFERRED EMBODIMENT

Figure 1:
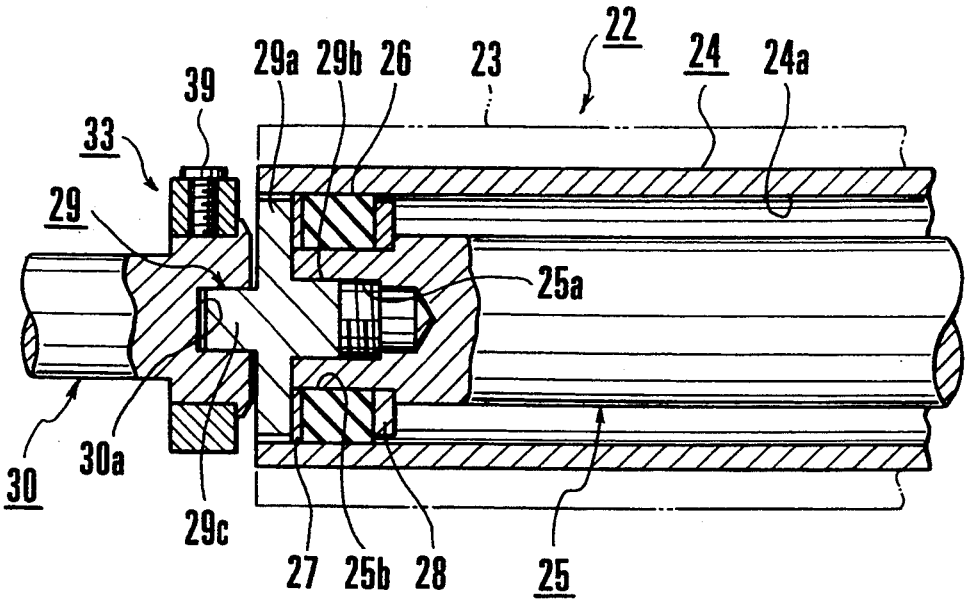
FIG. 1 is a longitudinally sectional view showing an arrangement of an end portion of a take-up roll of a cleaning apparatus for a printing press according to the present invention.
Figure 2:
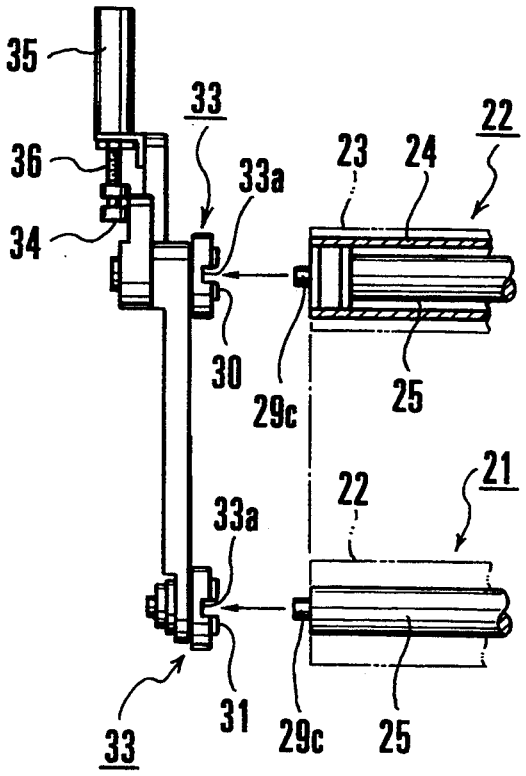
FIG. 2 is an exploded schematic front view showing a partial development of an arrangement of the take-up roll with its support member of the cleaning apparatus for a printing press according to the present invention.
Figure 3:
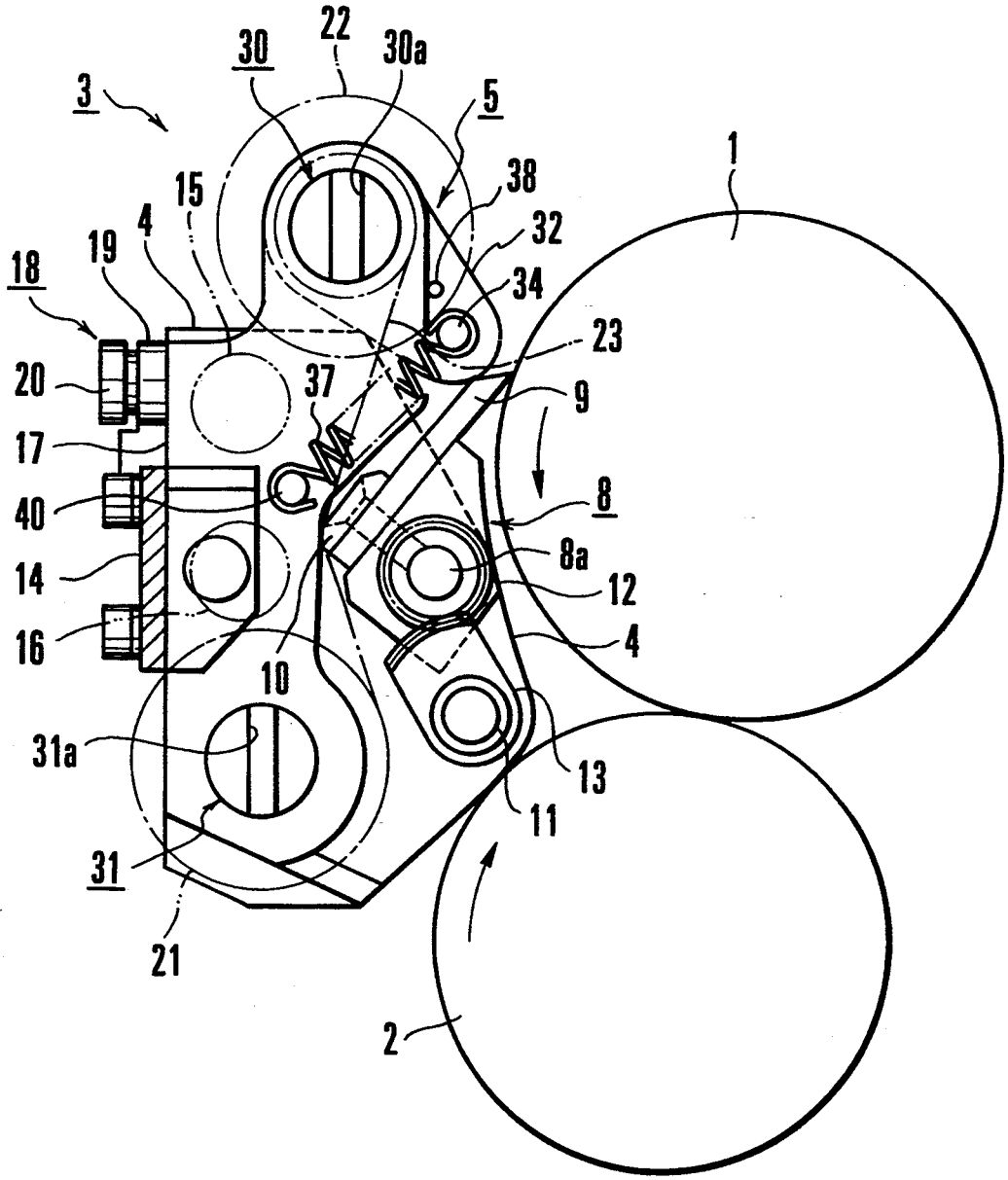
FIG. 3 is a side view showing a cleaning apparatus for a printing press according to an embodiment of the present invention.
Figure 4:
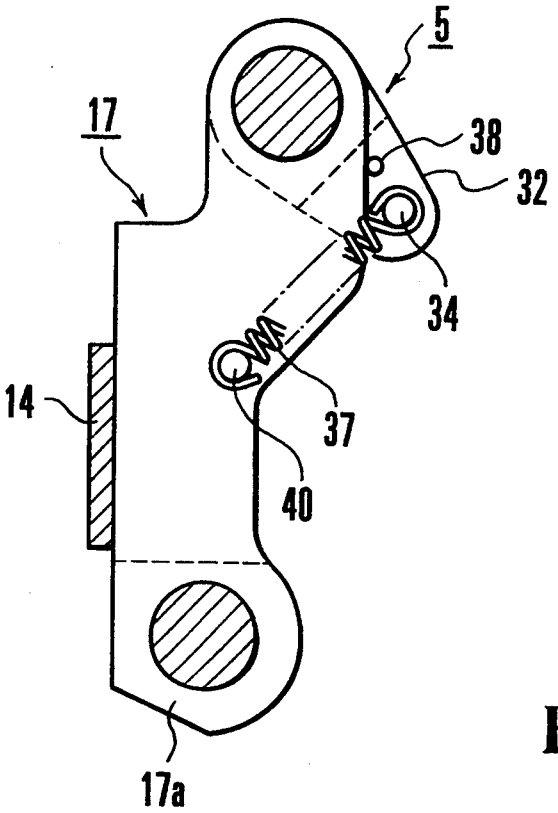
FIG. 4 is a side view of a cleaning unit shown in FIG. 3.
Figure 5:
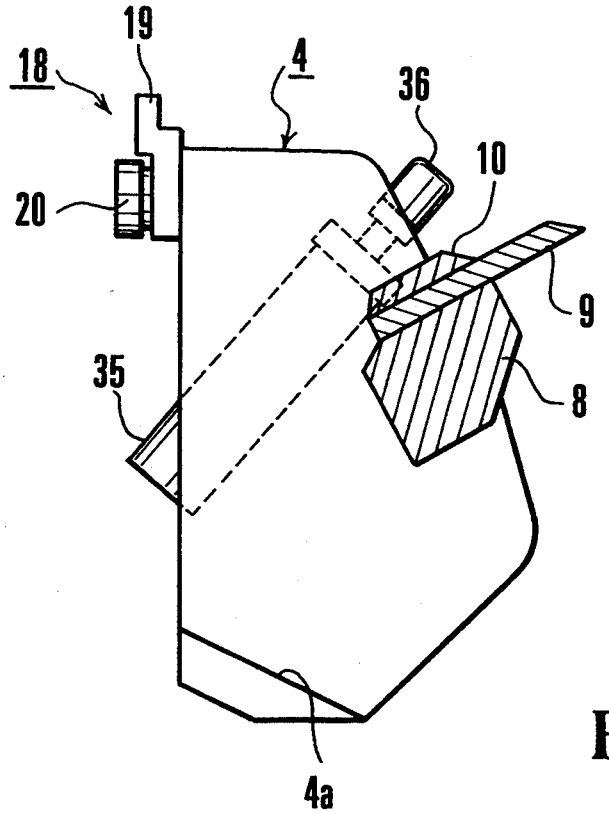
FIG. 5 is a side view of an apparatus frame shown in FIG. 3.
Figure 6:
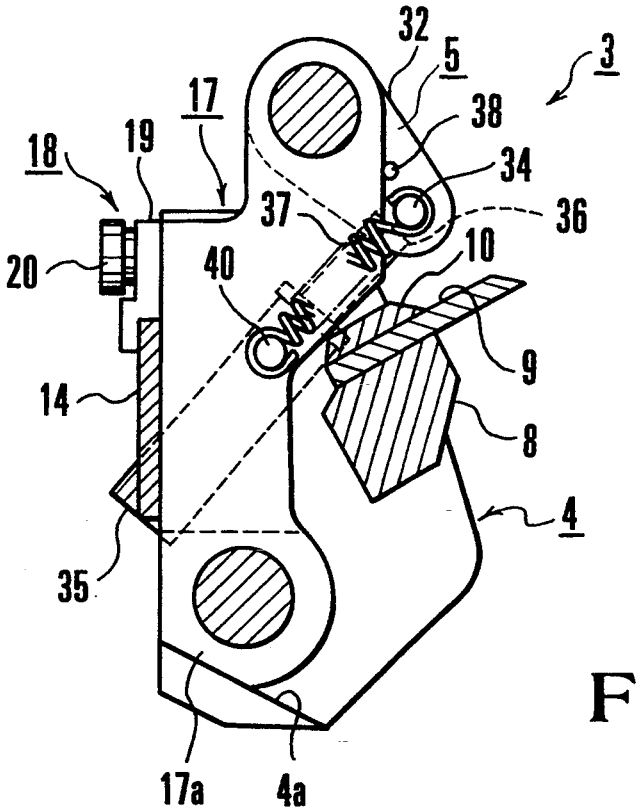
FIG. 6 is a side view of the main part of the cleaning apparatus for a printing press shown in FIG. 3.
Figure 7:
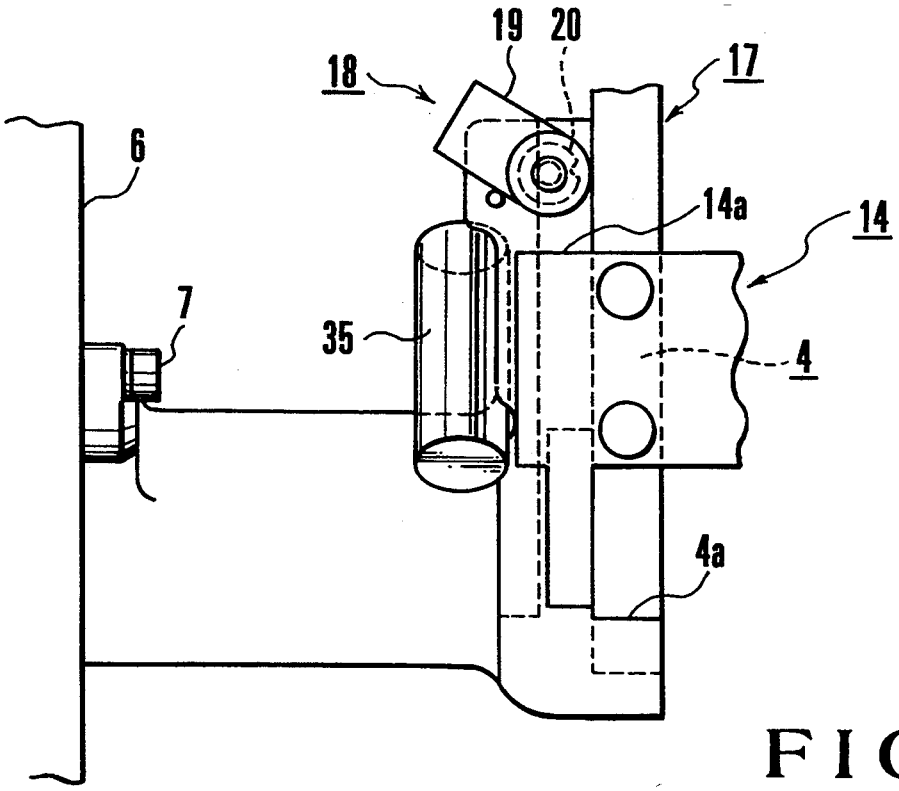
FIG. 7 is a front view of an apparatus frame shown in FIG. 3.

FIGS. 1 to 7 show an embodiment in which the support units of the cleaning web rollers of a printing press according to the present invention are put into practice for cleaning an ink roller, in which FIG. 1 shows the end portion of a take-up roll; FIG. 2 shows the take-up roll with its support member; FIG. 3 shows a cleaning apparatus; FIG. 4 shows a cleaning unit shown in FIG. 3; FIG. 5 shows an apparatus frame shown in FIG. 3; FIG. 6 shows the main part of the cleaning apparatus in a state wherein the cleaning unit is coupled to the apparatus frames; and FIG. 7 shows the apparatus frames.

Referring to FIG. 3, reference numerals 1 and 2 denote ink rollers. The circumferential surfaces of the ink rollers 1 and 2 oppose to contact each other, and the two end shafts of the both ink rollers 1 and 2 are supported by the bearings of a frame 6 (refer to FIG. 7). The ink rollers 1 and 2 are rotated in directions indicated by arrows in FIG. 3. An ink roller cleaning apparatus 3 is disposed on a side of the ink rollers 1 and 2. The ink roller cleaning apparatus 3 is constituted by apparatus frames 4 and a cleaning unit 5 detachably mounted on the apparatus frames 4.

Of the above components, as shown in FIG. 7, each of the pair of right and left apparatus frames 4 forms an L shape when seen from the front, and is fixed to the frame 6 with a bolt 7 to project inwardly of the frame 6. An elongated support bar 8 is pivotally supported by the end portions of the right and left apparatus frames 4 on the ink roller 1 sides with its two end shafts 8*a*. A doctor 9 extending in the axial direction of the ink roller 1 is fixed to the support bar 8 with a press plate 10.

As shown in FIG. 3, a gear shaft 11 is axially pivotally supported by the right and left apparatus frames 4 and extends under one end shaft 8*a* of the support bar 8, i.e., between one end shaft 8*a* of the support bar 8 and the circumferential surface of the ink roller 2. A segment gear 13 meshing with a gear 12 on this end shaft 8*a* is fixed to the gear shaft 11. When the gear shaft 11 is rotated each time through a predetermined angle by a drive unit (not shown) of the frame 6 in the forward and reverse directions, the doctor 9 is pivoted, by the meshing of the segment gear 13 and the gear 12, between a cleaning position where its distal end opposes to contact the circumferential surface of the ink roller 1, and an escape position where its distal end is separated from the circumferential surface of the ink roller 1.

A cleaning unit 5 having an elongated plate-like stay 14, round rod-like stays 15 and 16, and a pair of right and left brackets 17 is detachably supported on the apparatus frames 4 having the doctor 9 mounted thereon. The stays 15 and 16 are arranged above and below the stay 14, respectively. The brackets 17 are coupled to each other by the stays 14, 15, and 16.

When mounted, the cleaning unit 5 is arranged such that chamfered lower end faces 17*a* of the brackets 17 are supported by support surfaces 4*a* of the apparatus frames 4, as shown in FIG. 6, and such that end portions 14*a* of the stay 14 projecting toward the sides of the brackets 17 are supported by the vertical end faces of the apparatus frames 4, as shown in FIG. 7. The cleaning unit 5 is locked to the apparatus frames 4 by locking members 18 provided to the apparatus frames 4.

More specifically, the locking members 18 comprise stoppers 19 and finger set screws 20, and the stoppers 19 comprising pivotal stepped plate pieces are supported on the upper end portions of the vertical end faces of the apparatus frames 4, that support the end portions 14*a* of the stay 14, with the finger set screws 20 screwed in the screw holes of the apparatus frames 4. The stoppers 19 are pivoted from the state shown in FIG. 5 to the state shown in FIG. 6, i.e., counterclockwise in FIG. 7 so that their stepped portions are engaged with the end portions 14*a* of the stay 14. Thereafter, the set screws 20 are tightened, thereby locking cleaning unit 5 so as not to remove from the apparatus frames 4.

The two end portions of press members (to be described later) extending through the central portions of a supply roll 21 serving as a web roller and a take-up roll 22, respectively, are detachably supported on the lower and upper end portions of the brackets 17 of the cleaning unit 5 which is detachably supported by the apparatus frames 4 in the above manner. The supply roll 21 is constituted by a hollow core member 24 and a web 23 wound on the core member 24 in a separate step. The take-up roll 22 is constituted by another hollow core member 24 and the web 23 supplied from the supply roll 21 and wound on this core member 24.

The shaft assembly of the take-up roll 22 will be described in more detail with reference to FIG. 1. The support unit has a central shaft 25 supported in an inner hole 24*a* of the hollow core member 24. Small-diameter step portions 25*b* are formed on the two end portions of the central shaft 25. Annular pads 26, formed of an elastic material, e.g., rubber and serving as fixing members that can expand and contract in the axial and radial directions, are clamped by metal rings 27 and 28 and fitted between the small-diameter step portions 25*b* and the inner circumferential surface of the inner hole 24*a* of the core member 24.

Threaded portions 29*b* of press screws 29 constituting the press members together with the central shaft 25 are screwed in screw holes 25*a* formed at the central portions of the two end faces of the central shaft 25, such that they compress the pads 26 in the axial direction of the central shaft 25 with the flat surfaces of their flange portions 29*a*. As a result, the pads 26 expand in the radial direction of the central shaft 25, thereby fixing the central shaft 25 and the core member 24.

The shaft assembly of the take-up roll 22 has been described so far. The shaft assembly of the supply roll 21 has completely the same structure as that of the take-up roll 22. Press screws 29 compress pads 26 in the axial direction of a central shaft 25 of the support unit with the flat surfaces of their flange portions 29*a*, so that the pads 26 expand in the radial direction of the central shaft 25, thereby fixing the central shaft 25 and the core member 24.

Furthermore, projecting ridges 29*c* of the press screws 29 screwed with the supply and take-up rolls 21 and 22 are engaged with recessed grooves 30*a* and 31*a* in holders 30 and 31 rotatably provided to the upper and lower end portions of the brackets 17. Levers 32 are fitted on the shaft portions of the holders 30 for the supply roll 21 through one-way clutches.

Annular collars 33 each having a recessed radial groove 33*a* at one portion of the circumferential portion thereof are fitted on the holders 30 and 31 and fixed by set screws 39. The collars 33 serve to mount and remove the supply and take-up rolls 21 and 22. When the set screws 39 are loosened to pivot the collars 33 so that the recessed grooves 33*a* coincide with the recessed grooves 30*a* and 31*a* of the holders 30 and 31, the supply and take-up rolls 21 and 22 can be removed and mounted through the recessed grooves 33*a* of the collars 33.

The web 23 wound on the core member 24 of the mounted supply roll 21 is wound on the core member 24 as its distal end is guided by the take-up roll 22. The take-up roll 22 is intermittently rotated by a rotary drive unit (to be described later), so that the web 23 is drawn from the supply roll 21, brought into contact with the press plate 10 that presses the doctor 9, and taken up by the core member 24 of the take-up roll 22.

The rotary drive unit of the take-up roll 22 will be described. Pins 34 are provided to extend from the free end portions of the levers 32 fixed to the holders 30. Piston rods 36 of air cylinders 35 serving as the drive units mounted on the apparatus frames 4 oppose to contact the pins 34. More specifically, when the distal ends of the piston rods 36 push the pins 34, the movement of the piston rods 36 is converted to the pivotal force of the levers 32. The pins 34 and the piston rods 36 are not coupled by a coupling means but can be separated from each other. Tension coil springs 37 for pivoting the levers 32 clockwise in FIG. 3 to bias the levers 32 toward the distal ends of the piston rods 36 extend between the pins 34 and pins 40 provided to extend from the brackets 17. Reference numeral 38 denotes a stopper 38 for regulating the pivotal end limit of the corresponding lever 32.

When the piston rods 36 of the air cylinders 35 are reciprocally moved at a predetermined period, the levers 32 swing to reciprocate in the forward and reverse directions through the pins 34. Then, the take-up roll 22 is intermittently pivoted in one direction by the operation of the one-way clutches through the holders 30, so that the web 23 is taken up by the take-up roll 22.

The operation of the web cleaning apparatus having the arrangement as described above will be described with reference to FIGS. 8 to 11 that show the cleaning apparatus. When the ink roller 1 is to be cleaned, the central shaft 25 of the supply roll 21 prepared outside the printing press and mounted with the pads 26 is inserted in the inner hole 24*a* of the core member 24 on which the web 23 is wound in the separate step. The threaded portions 29*b* of the press screws 29 are screwed in the screw holes 25*a* at the two end portions of the inserted central shaft 25 and are clamped, respectively. Then, the pads 26 are compressed in the axial direction to extend in the radial direction, thereby fixing the central shaft 25 and the core member 24. Similarly, the central shaft 25 of the take-up roll 22 and the empty core member 24 on which the web 23 is not wound are fixed.

Then, set screws 39 are loosened to pivot the collars 33, so that the recessed grooves 33*a* of the collars 33 coincide with the recessed grooves 31*a* of the holders 31. The projecting ridges 29*c* of the press screws 29 are inserted in the recessed grooves 31*a* of the holders 31 through the coincident recessed grooves 33*a*. The collars 33 are then pivoted to shift the recessed grooves 33*a* and 31*a* from each other in the circumferential direction, and the collars 33 are fixed with the set screws 39, thereby mounting the supply roll 21. Similarly, the recessed grooves 33*a* of the collars 33 and the recessed grooves 30*a* of the holders 30 are caused to coincide with each other, and the take-up roll 22 is mounted on the holders 30.

Thereafter, the web 23 is drawn from the supply roll 21 and guided to the take-up roll 22, and the distal end of the web 23 is wound and fixed on the take-up roll 22, thereby preparing the cleaning unit 5. The lower end faces 17*a* of the brackets 17 of the cleaning unit 5 are supported by the support surfaces 4*a* of the apparatus frames 4, and the end portions 14*a* of the stay 14 projecting sideways are supported by the vertical end faces of the apparatus frames 4, so that the cleaning unit 5 mounted with the supply and take-up rolls 21 and 22 is supported by the apparatus frames 4.

Figure 8:
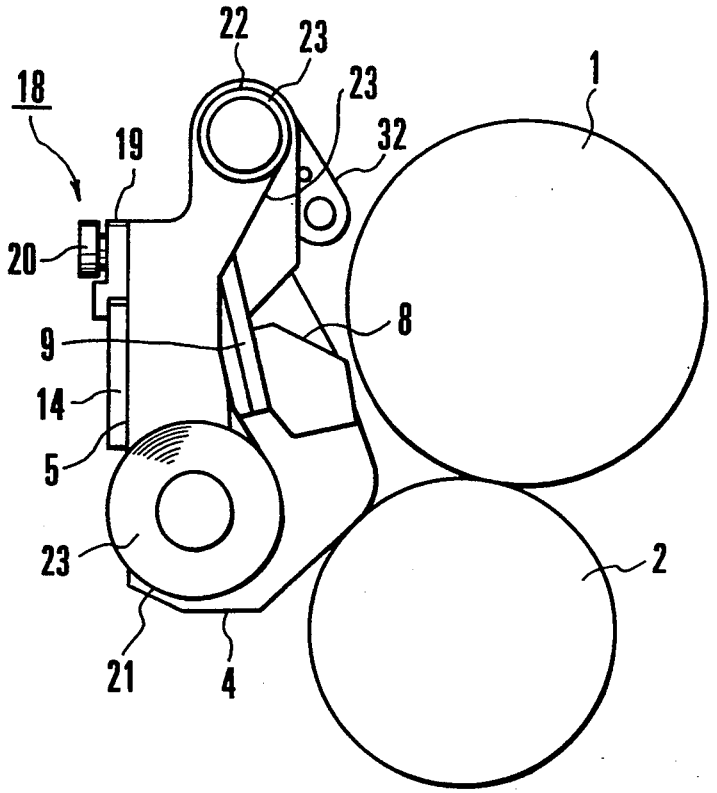
FIGS. 8 to 11 are side views of the cleaning apparatus for explaining the cleaning operation.

Furthermore, the stoppers 19 are pivoted from the state shown in FIG. 5 to the state shown in FIG. 6 so as to be engaged with the stay 14, and the set screws 20 are tightened, thereby supporting and fixing the cleaning unit 5 to the apparatus frames 4. FIG. 8 shows this state, wherein the doctor 9 is separated from the circumferential surface of the ink roller 1.

Figure 9:
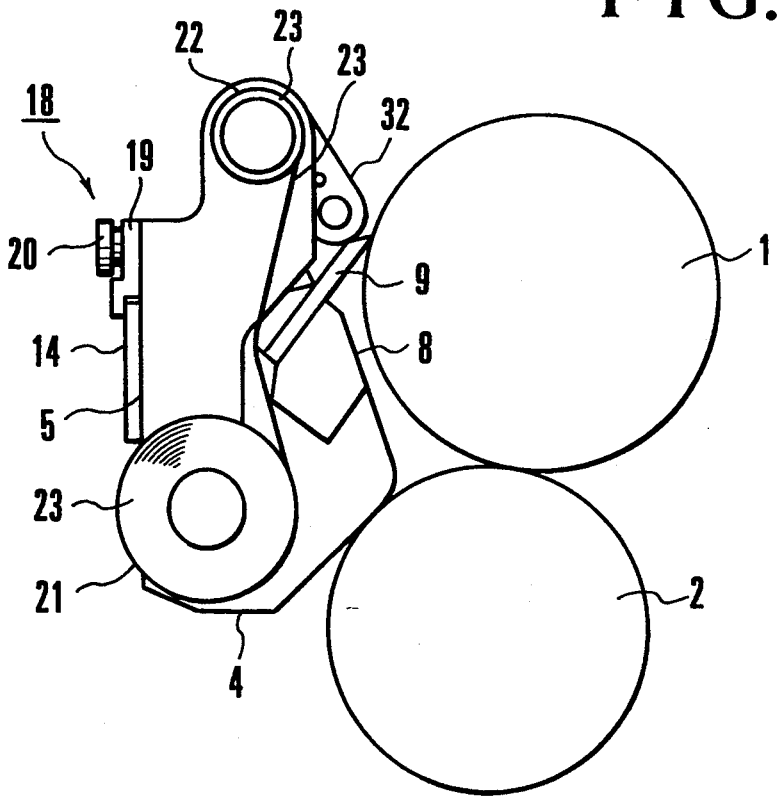

Subsequently, when the gear shaft 11 shown in FIG. 3 is pivoted by a drive unit (not shown), the doctor 9 is pivoted through meshing of the segment gear 13 and the gear 12, so that the distal end of the doctor 9 located above the proximal end portion thereof opposes to contact the circumferential surface of the ink roller 1. FIG. 9 shows this state.

After preparation is performed in this manner, the air cylinders 35 are operated to reciprocally move the piston rods 36 at a predetermined period. Then, the levers 32 are swung, and the take-up roll 22 is intermittently pivoted by the operation of the one-way clutches, so that the web 23 is intermittently driven. More specifically, when the piston rods 36 are moved forward to push the pins 34 with their distal ends, the levers 32 are pivoted through a predetermined angle in a direction to take up the web 23. When the piston rods 36 are retracted, the levers 32 are pivoted by the biasing force applied thereto in a direction opposite to the direction to take up the web 23, and are returned to the initial position. FIG. 9 shows a state wherein the piston rods 36 are retracted. The pivotal movement of the levers 32 which are biased clockwise, i.e., in a direction opposite to the direction to take up the web 23, is regulated by the stoppers 38 abutting against the cleaning unit 5. The pins 34 are disengaged from the distal ends of the piston rods 36.

Figure 10:
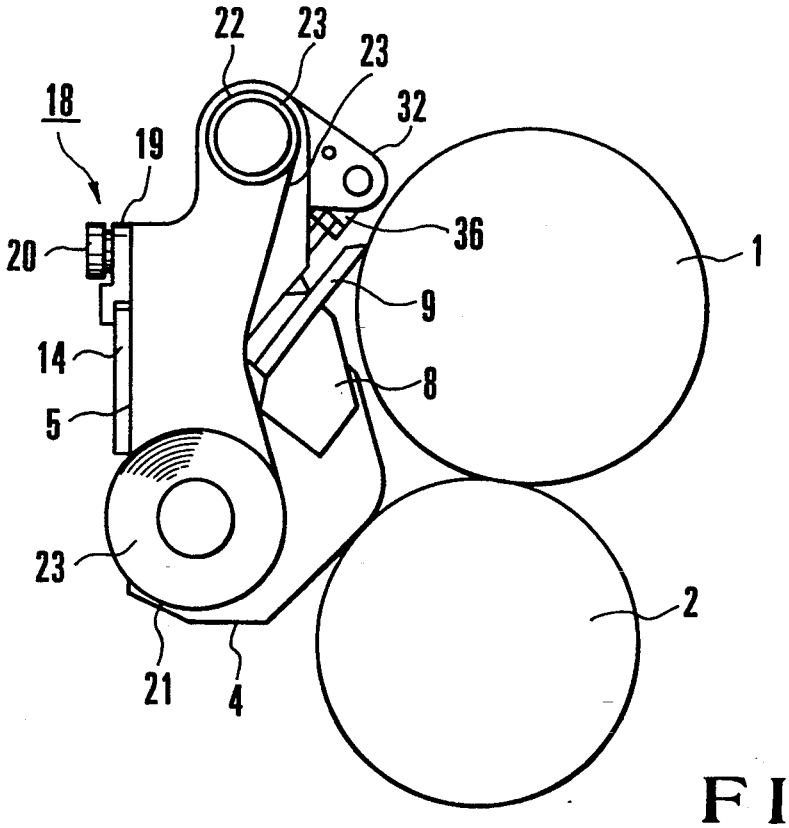

FIG. 10 shows a state wherein the piston rods 36 are moved forward. The levers 32 are pivoted counterclockwise, i.e., in a direction to take up the web 23 against the biasing force, and the stoppers 38 are separated from the cleaning unit 5. When the ink roller 1 is rotated in this state, the foreign matters attaching to the circumferential surface of the ink roller 1 are scraped by the distal end of the doctor 9, moved downward on the flat surface of the doctor 9, and transferred to the web 23 from the proximal end portion of the doctor 9. The web 23 passing by the proximal end portion of the doctor 9 is taken up by the take-up roll 22 with the foreign matters attaching to it.

Figure 11:
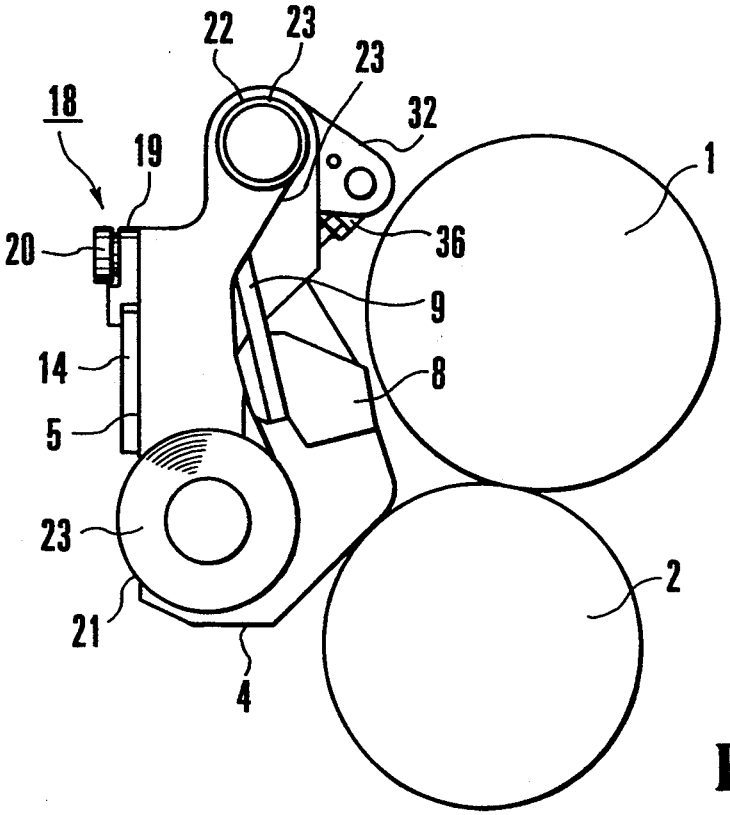

When the cleaning operation of the ink roller 1 is ended, the gear shaft 11 is pivoted to pivot the doctor 9 such that its distal end is separated from the circumferential surface of the ink roller 1, as shown in FIG. 11. Then, the set screws 20 are loosened. The stoppers 19 are pivoted to the position shown in FIGS. 5 and 7, thereby disengaging the cleaning unit 5 and the apparatus frames 4 from each other. Then, the entire cleaning unit 5 is removed from the apparatus frames 4. At this time, since the piston rods 36 of the air cylinders 35 are retracted and the distal ends of the piston rods 36 are not engaged with the pins 34, the cleaning unit 5 can be easily removed from the apparatus frames 4 having the air cylinders 35.

When the web 23 on the supply roll 21 runs out during the cleaning operation and need be exchanged, the set screws 39 are loosened to pivot the collars 33 so that the recessed grooves 33*a* of the collars 33 coincide with the recessed grooves 31*a* and 30*a* of the holders 31 and 30. Then, the supply and take-up rolls 21 and 22 are removed outside the printing press. Hence, an empty core member 24 and a core member 24 having the web 23 wound on it can be easily exchanged by an operation reverse to the mounting operation described above.

This embodiment is exemplified by an ink roller as the body to be cleaned. However, the present invention is not limited to this, but a printing cylinder, e.g., a blanket cylinder or an impression cylinder, may be cleaned. In this embodiment, a doctor is provided to scrape the foreign matters. However, a doctor is not necessarily provided, but a web may be directly pressed against the circumferential surface of the cylinder or roller, thereby removing the foreign matters.

In this embodiment, the air cylinders 35 are used as means for intermittently pivoting the take-up roll 22. However, the present invention is not limited to them, but motors or the like may be used instead. Furthermore, in this embodiment, the stoppers 19 serving as the fixing means for fixing the cleaning unit 5 and the apparatus frames 4 with each other are supported by the apparatus frames 4. However, the stoppers 19 may be supported by the cleaning unit. The web 23 is not limited to a cloth, but may be paper.

The air cylinders 35, the levers 32, and one-way clutches (not shown) need not be arranged on the two sides. They may be arranged on one side.

As is apparent from the above description, according to the present invention, the cleaning unit for rotatably supporting the supply and take-up rolls is fixed on the frames with fixing means, and drive units for driving the take-up roll are provided to the frames. Therefore, the weight of the entire cleaning unit is greatly decreased. Since air piping of the drive units and the electric disconnections become unnecessary, the load to the worker is decreased. Since the time required for mounting and removing the cleaning unit on and from the apparatus frames is shortened, thus shortening the preparation time, the operability of the printing press is improved.

What is claimed is:

1. A cleaning apparatus for a printing press, comprising:

a cleaning unit, having a supply roll on which a web for cleaning a cylinder/roller is wound and a take-up roll for taking up said web drawn from said supply roll, for rotatably supporting said supply and take-up rolls;

a frame for detachably supporting said cleaning unit;

holding means for fixing and holding said cleaning unit on said frame; and driving means, fixed on said frame, for rotating said take-up roll in a direction to take up said web, said driving means having a rod member which reciprocates; and transmitting means, separably coupled to said driving means, for transmitting a drive force of said driving means fixed to said frame to said take-up roll of said cleaning unit as a rotating force, said transmitting means comprising a pin with which a distal end of said rod member is brought into contact, a lever on which said pin is provided to extend therefrom and which is pivoted through a predetermined angle together with said pin when said rod member is moved forward, a spring for biasing said,lever to pivot in a direction to retract said rod member, and a one-way clutch for transmitting, to said take-up roll, a pivotal movement of said lever in only a direction to take up said web.

2. An apparatus according to claim 1, wherein said holding means comprises a stopper member, and said cleaning unit is selectively moved between a mounting position for holding said cleaning unit on said frame in a mounted state, and an escape position for mounting and removing said cleaning unit on and from said frame, said apparatus further comprising a lock member for locking said stopper member when said cleaning unit is at the mounting position.

3. An apparatus according to claim 2, wherein said stopper member comprises a stepped plate piece pivotally provided to said frame and engageable with a plate-like member of said cleaning unit, and said lock member comprises a set screw for axially pivotally supporting said plate piece and clamping said plate piece while said set screw is engaged with said plate-like member of said cleaning unit.

4. An apparatus according to claim 1, wherein said cleaning unit comprises a pair of right and left brackets and stays for coupling said brackets with each other, and said frame supports at least lower end faces of said brackets.

5. An apparatus according to claim 1, further comprising a stopper for regulating a pivot limit of said lever in a direction to retract said rod member of said driving means, thereby releasing a contact state of said distal end of said rod member and said pin.

6. An apparatus according to claim 1, wherein said supply and take-up rolls respectively have shaft assemblies on which said web is wound, and said cleaning unit detachably supports two ends of said respective shaft assemblies.

7. A cleaning apparatus for a printing press, comprising:

a cleaning unit, having a supply roll on which a web for cleaning a cylinder/roller is wound and a take-up roll for taking up said web drawn from said supply roll, for rotatably supporting said supply and take-up rolls;

a frame for detachably supporting said cleaning unit;

holding means for fixing u and holding said cleaning unit on said frame; and driving means, fixed on said frame, for rotating said take-up roll in a direction to take up said web:

wherein said supply and take,up rolls respectively have shaft assemblies on which said web is wound, and said cleaning unit detachably support two ends of said respective shaft assemblies:

wherein said shaft assemblies respectively have projecting ridges formed on two ends thereof, said cleaning unit has a pair of holders having first recessed grooves engaged with said projecting ridges of said shaft assemblies and rotatable integrally with said supply and take-up rolls, annular collars pivotally provided on outer circumferential surfaces of said holders and having second recessed grooves each formed at a portion of a circumferential portion thereof, and set screws for fixing said collars to said holders, and the first recessed grooves of said holders am caused to coincide with the second recessed grooves of said collars and said projecting ridges of said shaft assemblies are slid, thereby mounting and removing said supply and take-up rolls.

8. A cleaning apparatus for a printing press, comprising:

a cleaning unit, having a supply roll on which a web for cleaning a cylinder/roller wound and a take-up roll for taking up said web drawn from said supply roll, for rotatably supporting said supply and take-,up rolls:

a frame for detachably supporting said cleaning unit:

holding means for fixing and holding said cleaning unit on said frame: and driving means, fixed on said frame, for rotating said take-up roll in a direction to take up said web:

wherein said supply and take-up rolls respectively have shaft assemblies on which said web is wound, and said cleaning unit detachably supports two ends of said respective shaft assemblies:

wherein each of said shaft assemblies has a hollow core member on which said web is wound, a central shaft inserted in said core member and having two end faces respectively formed with screw holes therein, pads made of annular elastic bodies and fitted and fixed between two end portions of said central shaft and an inner circumferential surface of said core member, and press screws formed with threaded portions screwed with the screw holes of said central shaft, collar portions for pressing said pads in an axial direction, and projecting ridges rotatably supported by said cleaning unit.

9. An apparatus according to claim 1, wherein said cleaning unit comprises a doctor which operates to oppose contact with a circumferential surface of an ink roller, scrape foreign matters and transfer the scraped foreign matters from a proximal end portion said cleaning unit to said web traveling from said supply roll to said take-up roll.

10. An apparatus according to claim 1, wherein said driving means comprising an air cylinder having said rod member.

11. An apparatus according to claim 11, further comprising a pivoting mechanism, provided on said frame, for pivoting said doctor, said pivoting mechanism being held on said frame when said cleaning unit is dismounted from said frame.

* * * * *

UNITED STATES PATENT AND TRADEMARK OFFICE

CERTIFICATE OF CORRECTION

PATENT NO. : 5,425,309

DATED : June 20, 1995

INVENTOR(S) : Saito, et al

It is certified that error appears in the above-indentified patent and that said Letters Patent is hereby corrected as shown below:

In claim 1 in column 8 at line 4 change "said,lever" to --said lever--

In claim 7 in column 8 at line 49 change "fixing u and" to --fixing and--;

line 52 change "web:" to --web;--;

line 53 change "take,up" to --take up--;

line 56 change "assemblies:" to --assemblies;-- line 68 change "am caused" to --are caused--

UNITED STATES PATENT AND TRADEMARK OFFICE

CERTIFICATE OF CORRECTION

PATENT NO. : 5,425,309

DATED : June 20, 1995

INVENTOR(S) : Saito, et al

It is certified that error appears in the above-indentified patent and that said Letters Patent is hereby corrected as shown below:

In claim 8 in column 9 at line 8 after "roller" insert --is--;
lines 10-11 change "take-,up rolls:" to --take-up rolls;--
line 14 change "frame: and" to --frame; and--
line 16 change "web:" to --web;--
line 20 change "assemblies:" to --assemblies--;

In claim 11 at line 19 change "claim 11" to --claim 9--.

Signed and Sealed this

Ninth Day of January, 1996

Bruce Lehman

*Attest:*

BRUCE LEHMAN

*Attesting Officer*

*Commissioner of Patents and Trademarks*